US009556549B2

(12) United States Patent
Bodine et al.

(10) Patent No.: US 9,556,549 B2
(45) Date of Patent: Jan. 31, 2017

(54) CLOTHES MOVER FOR AN AUTOMATIC WASHER

(71) Applicant: WHIRLPOOL CORPORATION, Benton Harbor, MI (US)

(72) Inventors: Darryl C. Bodine, Saint Joseph, MI (US); David W. Carr, Saint Joseph, MI (US); Dale E. Mueller, Benton Harbor, MI (US); Basak Oguz, Saint Joseph, MI (US); Jon D. Strait, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/819,493

(22) Filed: Aug. 6, 2015

(65) Prior Publication Data

US 2015/0337474 A1 Nov. 26, 2015

Related U.S. Application Data

(63) Continuation-in-part of application No. 13/494,340, filed on Jun. 12, 2012, now Pat. No. 9,347,166.

(51) Int. Cl.

| | |
|---|---|
| ***D06F 13/00*** | (2006.01) |
| ***D06F 17/10*** | (2006.01) |
| ***D06F 37/06*** | (2006.01) |
| ***D06F 37/14*** | (2006.01) |

(52) U.S. Cl.

CPC ..... *D06F 17/10* (2013.01); *D06F 37/06* (2013.01); *D06F 37/14* (2013.01)

(58) Field of Classification Search

CPC ..... D06F 33/02; D06F 13/00; D06F 13/02; D06F 23/04; D06F 39/008

USPC ... 8/137, 159, 158; 68/134, 133, 12.02, 131, 68/13 R, 132, 54; 366/314, 205, 331, 343, 317, 366/279; 134/34, 184, 18, 32, 157

See application file for complete search history.

(56) References Cited

U.S. PATENT DOCUMENTS

| | | | |
|---|---|---|---|
| 1,619,637 | A | 3/1927 | Schroeder |
| 2,619,827 | A | 12/1952 | Castricone |
| 2,726,529 | A | 12/1955 | Clark |
| 2,763,147 | A | 9/1956 | Thiele |
| 3,112,632 | A | 12/1963 | Walton |
| 3,129,575 | A | 4/1964 | Biffani |
| 3,276,228 | A | 10/1966 | Ruiz |
| 3,285,040 | A | 11/1966 | Bochan |
| 3,296,840 | A | 1/1967 | Tichenor |
| 3,307,383 | A | 3/1967 | Cobb et al. |
| 3,388,570 | A | 6/1968 | Cobb et al. |

(Continued)

FOREIGN PATENT DOCUMENTS

| | | | |
|---|---|---|---|
| CN | 2505501 | Y | 8/2002 |
| CN | 201793938 | U | 4/2011 |

(Continued)

*Primary Examiner* — David Cormier
*Assistant Examiner* — Thomas Bucci

(57) ABSTRACT

A washing machine for treating laundry comprising a basket rotatable about a first rotational axis, having a peripheral side wall extending upwardly from a bottom wall to at least partially define a treating chamber; a clothes mover proximate the bottom wall, having a base with a centrally located hub concentric with a second rotational axis about which the clothes mover reciprocally rotates; and at least one vane having an elongated body extending away from the hub and projecting upwardly from the clothes mover to terminate in a tip.

16 Claims, 9 Drawing Sheets

(56) References Cited

U.S. PATENT DOCUMENTS

| | | | |
|---|---|---|---|
| 3,600,902 | A | 8/1971 | Williams |
| 3,651,672 | A | 3/1972 | Salisbury |
| 3,736,775 | A | 6/1973 | Smith |
| 3,738,130 | A | 6/1973 | Smith |
| 4,018,067 | A | 4/1977 | Vona, Jr. et al. |
| 4,068,503 | A | 1/1978 | Platt |
| 4,137,736 | A | 2/1979 | Platt et al. |
| 4,338,802 | A | 7/1982 | Ohmann et al. |
| 4,555,919 | A | 12/1985 | Brenner et al. |
| 4,779,431 | A | 10/1988 | Burk et al. |
| 5,231,857 | A | 8/1993 | Rew et al. |
| 5,440,903 | A | 8/1995 | Kropf et al. |
| 5,477,708 | A | 12/1995 | Savkar et al. |
| 5,765,406 | A | 6/1998 | Youn |
| 5,784,902 | A | 7/1998 | Pinkowski et al. |
| 5,839,299 | A | 11/1998 | Lee |
| 5,887,457 | A | 3/1999 | Yu |
| 6,212,722 | B1 | 4/2001 | Pinkowski et al. |
| 7,069,752 | B2 | 7/2006 | Clark et al. |
| 7,506,525 | B2 | 3/2009 | La Belle et al. |
| 7,628,044 | B2 | 12/2009 | Kopyrin et al. |
| 7,793,525 | B2 * | 9/2010 | Kopyrin ..... D06F 13/02 68/133 |
| 8,028,550 | B2 | 10/2011 | Duncan et al. |
| 8,387,422 | B2 | 3/2013 | Hettinger et al. |
| 2006/0162094 | A1 | 7/2006 | La Belle et al. |
| 2013/0326822 | A1 | 12/2013 | Carr et al. |
| 2015/0033803 | A1 | 2/2015 | Carr et al. |

FOREIGN PATENT DOCUMENTS

| | | | |
|---|---|---|---|
| CN | 203530685 | U | 4/2014 |
| GB | 760007 | | 10/1956 |
| JP | 1268592 | A | 10/1989 |
| JP | 2007007091 | A | 1/2007 |
| KR | 20010000993 | A | 1/2001 |
| RU | 2405075 | C1 | 11/2010 |

* cited by examiner

CLOTHES MOVER FOR AN AUTOMATIC WASHER

CROSS-REFERENCE TO RELATED APPLICATIONS

This application is a continuation-in-part of U.S. patent application Ser. No. 13/494,340, filed Jun. 12, 2012, which is incorporated herein by reference in its entirety.

BACKGROUND OF THE INVENTION

Effective cleaning of laundry items in an automatic washing machine, be it a vertical or horizontal axis machine, may be attributable primarily to three factors: chemical energy, thermal energy, and mechanical energy. These three factors may be varied within the operational limits of a selected automatic washing machine to obtain a desired degree of cleaning.

Chemical energy may be related to the types of wash aids, e.g. detergent and bleach, applied to the laundry items. Thermal energy relates to the temperature of the laundry items, which may be established by the temperature of the wash liquid or the use of steam.

Mechanical energy may be attributable to the contact between an oscillating clothes mover and the laundry items, the contact between laundry items themselves, and the movement of washing liquid through the laundry items. Mechanical energy may be also related to the size and configuration of the clothes mover.

There may be benefits to utilizing a clothes mover having a low profile, typically referred to as an impeller, as opposed to a vertical axis agitator with a tall profile. However, low profile clothes movers may be less effective in moving laundry items than elongated agitators, particularly if the laundry load is treated in a reduced level of wash liquid.

BRIEF SUMMARY OF THE INVENTION

In one aspect, a washing machine for treating laundry according to at least one automatic cycle of operation, includes a basket having a bottom wall and a peripheral side wall extending upwardly from the bottom wall to at least partially define a treating chamber with an open top, with the basket rotatable about a first rotational axis, a clothes mover located within the treating chamber, proximate the bottom wall, and having a base with a centrally located hub concentric with a second rotational axis about which the clothes mover reciprocally rotates, a plurality of flexible vanes having an elongated body extending away from the hub and projecting upwardly from the clothes mover, wherein each of the plurality of flexible vanes includes a flexible body portion to terminate in a tip, with the elongated body having a first end proximate the hub and flexible tip extending away from the flexible body portion. The flexible vanes flex about a first flex axis defined by the flexible body portion and a second flex axis defined by the flexible tip, and wherein the first flex axis and second flex axis that is are not parallel to either of the first and second rotational axes.

In another aspect, a method of operating a laundry treating appliance having a clothes mover rotatable about a first axis of rotation, a plurality of vanes extending from the clothes mover including a body portion and a tip, and the clothes mover located within a treating chamber at least partially defined by a perforate basket having a peripheral side wall, includes flexing the vanes about a first flex axis defined by the body portion and a second flex axis defined by the tip, by the rotation of the clothes mover about the first axis of rotation to impart an upward force on any laundry in contact with a portion of the vanes lying within a radial distance from the first axis of rotation that is no greater than half the distance between the first axis of rotation and the peripheral side wall.

DESCRIPTION OF AN EMBODIMENT OF THE INVENTION

Conventional automatic washing machines enable a user to select one of several laundering options based upon the type of laundry load being placed in the washing machine. For example, selectable options may include "normal," "delicates," "woolens," and the like. These may be typically referred to as "cycles." As utilized herein, "laundering cycle" may refer to a specific cycle, such as "normal," extending from the beginning of the cycle to its completion. A laundering cycle may generally consist of at least a wash cycle, a rinse cycle, and a spin cycle. The wash cycle, the rinse cycle, and the spin cycle may consist of several steps, such as a fill step, a drain step, a pause step, an agitation step, and the like. The invention may be used with any laundering cycle regardless of the types and combination of steps.

Figure 1:
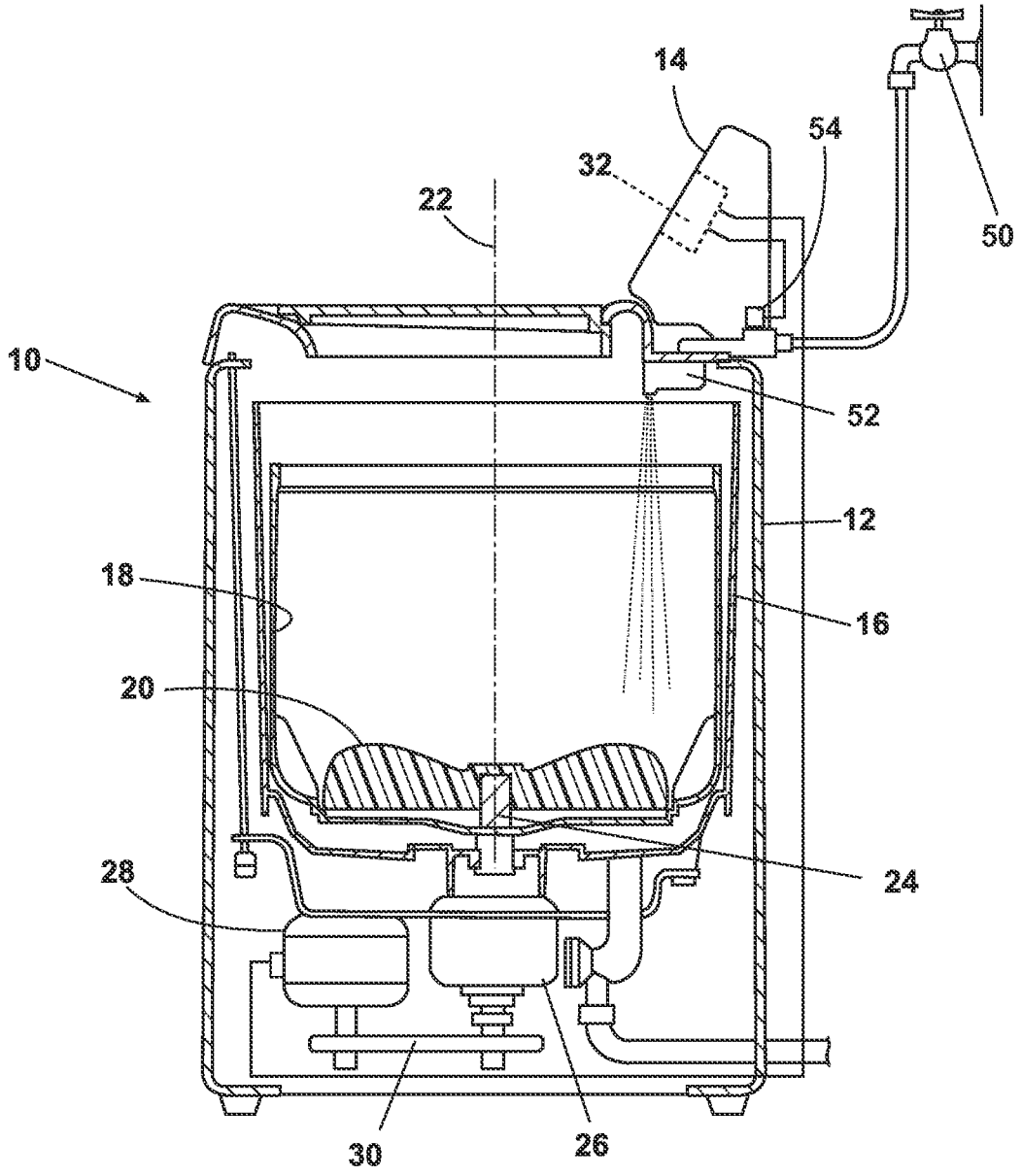
FIG. 1 is a partially cutaway elevation view of an automatic washing machine illustrating internal components thereof, including a perforate basket and an oscillating clothes mover, according to an exemplary embodiment of the invention.

FIG. 1 illustrates an embodiment of the invention consisting of a vertical axis automatic washing machine 10 comprising a cabinet 12 having a control panel 14 housing a machine controller 32, and enclosing a liquid-tight tub 16 defining a wash chamber in which may be located a perforate basket 18 having a peripheral wall. Thus, laundry items placed in the basket 18 may be placed in the wash chamber. A clothes mover 20 adapted for imparting movement to a laundry load contained within the basket 18 may be disposed in the bottom of the basket 18. The clothes mover 20 is illustrated as a low profile vertical axis impeller having a plurality of circular openings therethrough for drainage of wash liquid during movement of the clothes mover 20. Alternatively, the clothes mover 20 may have openings of other than a circular configuration, or may have no openings. The clothes mover 20 may oscillate about a first axis of rotation, and the basket 18 may rotate about a second axis of rotation. The first and second axes of rotation may be coaxially aligned to define a vertically-oriented axis of rotation, or oscillation axis 22.

Figure 2:
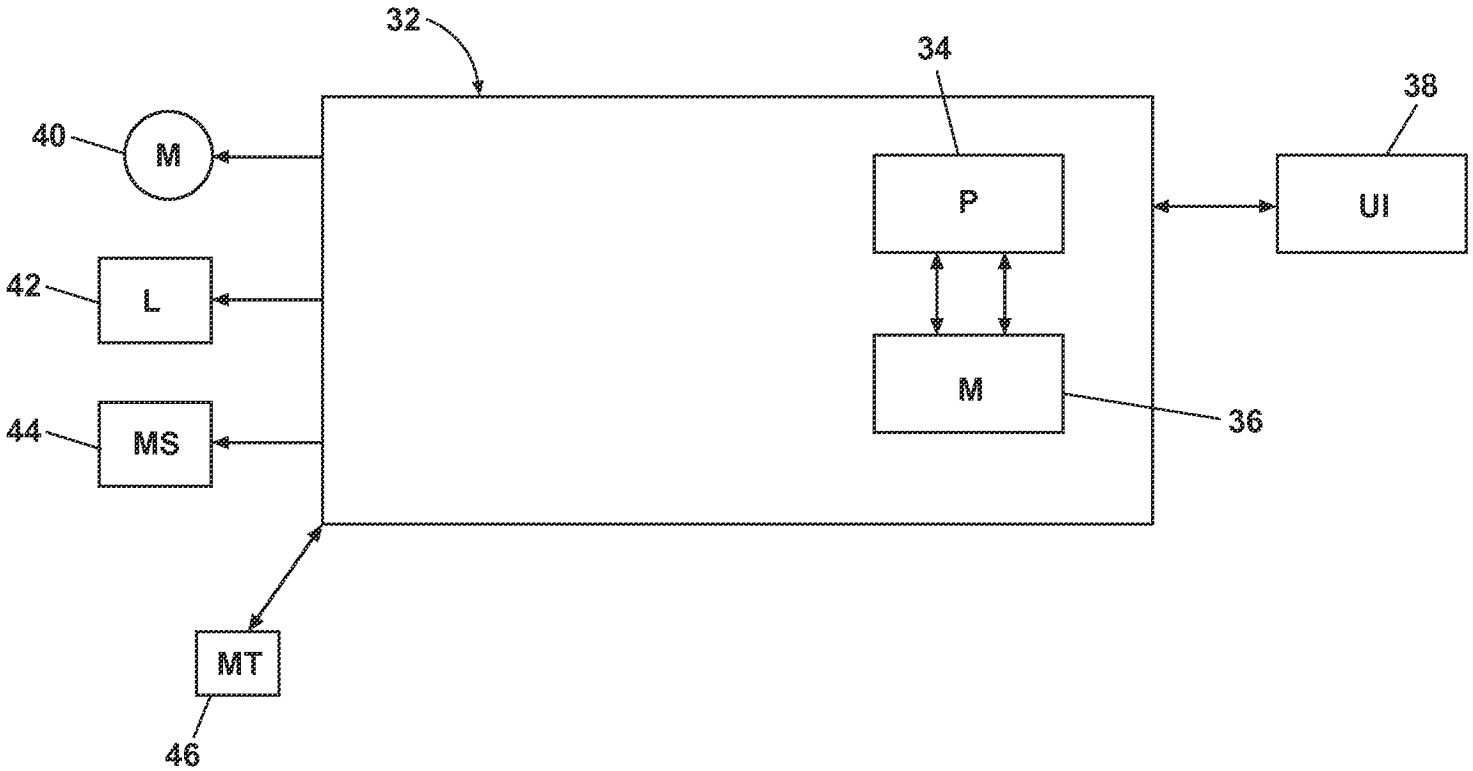
FIG. 2 is a schematic view of a machine controller for controlling the operation of internal components of the washing machine illustrated in FIG. 1.

The clothes mover 20 may be operably connected to a drive motor 28 through an optional transmission 26 and drive belt 30. The transmission 26 may be fixedly coupled with a clothes mover drive shaft 24 operably engaging the clothes mover 20 for synchronized oscillation. As illustrated in FIG. 2, the machine controller 32 may be provided with a central processing unit (CPU) 34 and a memory 36. The memory 36 may be used for storing the control software that may be executed by the CPU 34 in completing a cycle of operation using the washing machine 10, and any additional software. Examples, without limitation, of cycles of operation include: wash, heavy duty wash, delicate wash, quick wash, pre-wash, refresh, rinse only, and timed wash.

The memory 36 may store information in a suitable format, such as a database or table, and may store data received from one or more components of the washing machine 10 that may be communicably coupled with the machine controller 32. The database or table may be used to store the various operating parameters for the one or more cycles of operation, including factory default values for the operating parameters and any adjustments to them by the control system or by user input.

The controller 32 may be operably coupled with one or more components of the washing machine 10 for communicating with and controlling the operation of the component to complete a cycle of operation. For example, the machine controller 32 may be operably coupled with a motor controller 40 integral with the motor 28. The controller 32 may also be operably coupled with a steam generator, a sump heater to heat wash liquid as required by the machine controller 32, one or more pumps, one or more valves for controlling the flow of liquid during a cycle of operation, and the like.

The machine controller 32 may also be coupled with one or more sensors provided in one or more of the systems of the washing machine 10 for processing and storing information from the sensors. Non-limiting examples of sensors that may be communicably coupled with the machine controller 32 include a motor speed sensor 44 for determining a speed output indicative of the rotational speed of the motor 28, and a motor torque sensor 46, which may be used to determine a variety of system and laundry characteristics, such as laundry load inertia or mass. The motor speed sensor 44 may be a separate component, or may be integrated directly into the motor 28. Regardless of the type of speed sensor employed, or the coupling of the drum 16 with the motor 28, the speed sensor 44 may be adapted to enable the controller 32 to determine the rotational speed of the drum 16 from the rotational speed of the motor 28.

The motor torque sensor 46 may be a separate component, or may be integrated with the motor controller 40, to provide data communication with the motor 28 and output motor characteristic information, such as oscillations, generally in the form of an analog or digital signal, to the machine controller 32 that may be indicative of the applied torque. The controller 32 may use the motor characteristic information to determine the torque applied by the motor 28 using a computer program that may be stored in the controller memory 36. Specifically, the motor torque sensor 46 may be any suitable sensor, such as a voltage or current sensor, for outputting a current or voltage signal indicative of the current or voltage supplied to the motor 28 to determine the torque applied by the motor 28. Additionally, the motor torque sensor 46 may be a physical sensor or may be integrated with the motor 28 and, combined with the capability of the machine controller 32, may function as a sensor. For example, motor characteristics, such as speed, current, voltage, direction, torque etc., may be processed such that the data provides information in the same manner as a separate physical sensor. Contemporary motors often have a dedicated controller that outputs data for such information.

One or more load, or mass, sensors 42 may be included in the washing machine 10 and may be positioned in any suitable location for providing an output signal indicative of the load or mass of the rotating drum and laundry, either quantitative (inertia, mass, weight, etc.) or qualitative (small, medium, large, etc.), within the treating chamber 18. By way of non-limiting example, it may be contemplated that the amount of laundry in the treating chamber may be determined based on the weight of the laundry and/or the volume of laundry in the treating chamber 18. Thus, one or more load sensors 42 may output a signal indicative of either the weight of the laundry load in the treating chamber 18 or the volume of the laundry load in the treating chamber 18.

As illustrated in FIG. 2, one or more well-known sensors may be operably coupled with the machine controller 32, such as a motor speed sensor 44, current sensor, voltage sensor, and the like. Outputs from the sensors may be delivered to a machine controller 32 in the control panel 14. In many applications, the sensors form part of a motor controller coupled to the machine controller 32. The machine controller 32 may be adapted to send and receive signals for controlling the operation of the washing machine 10, receiving data from the sensors, processing the data, displaying information of interest to a user, and the like.

The washing machine 10 may also be connected to a source of water 50 which may be delivered to the tub 16 through a nozzle 52 controlled by a valve 54 operably coupled with the machine controller 32. The valve 54 and the machine controller 32 may enable a precise volume of water to be delivered to the tub 16 for washing and rinsing. Wash liquid may be at any level within the tub 16 from merely wetting the laundry items to fully submerging the laundry items.

Figure 3:
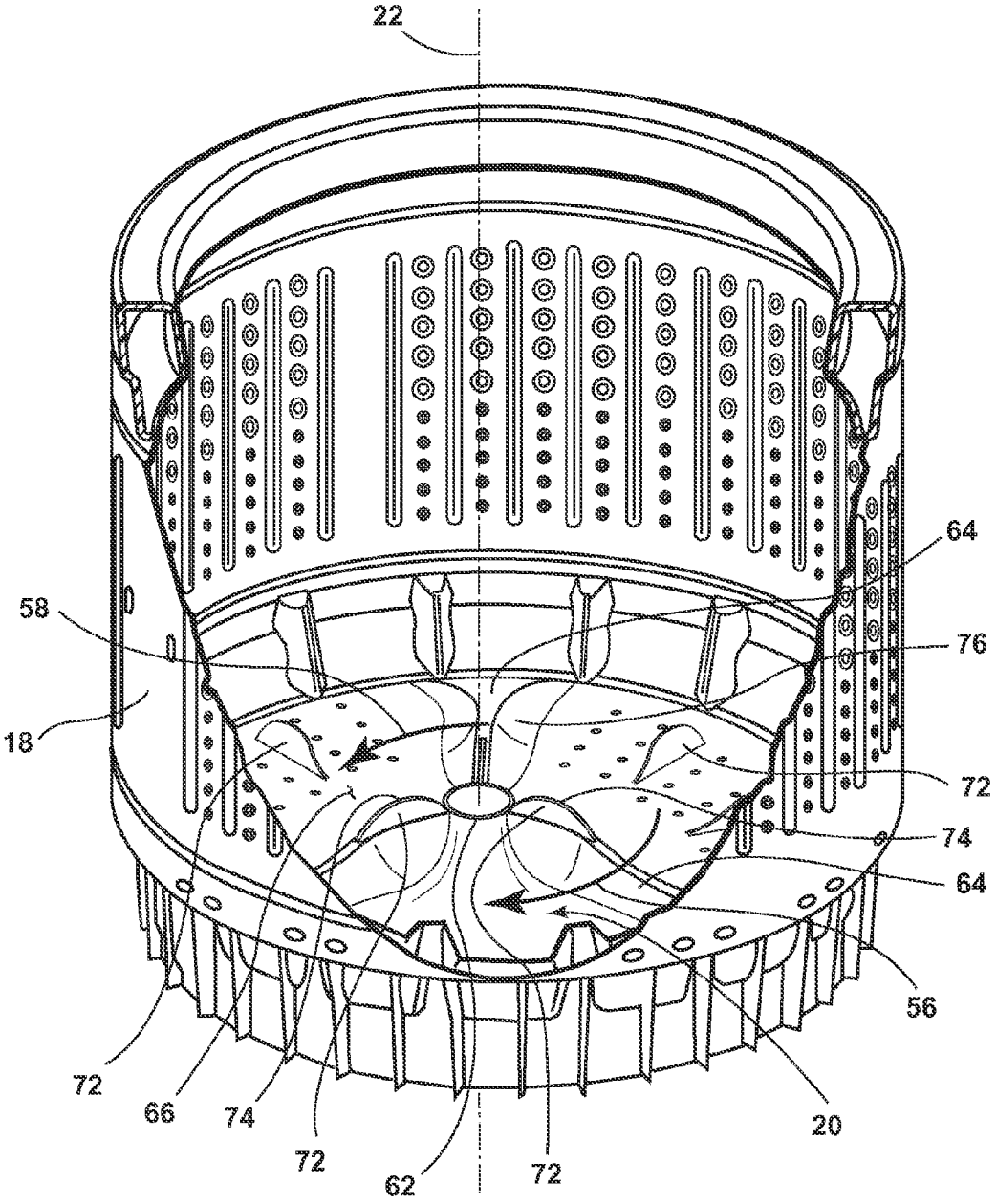
FIG. 3 is a partially cutaway perspective view of the perforate basket and clothes mover illustrated in FIG. 1.
Figure 4:
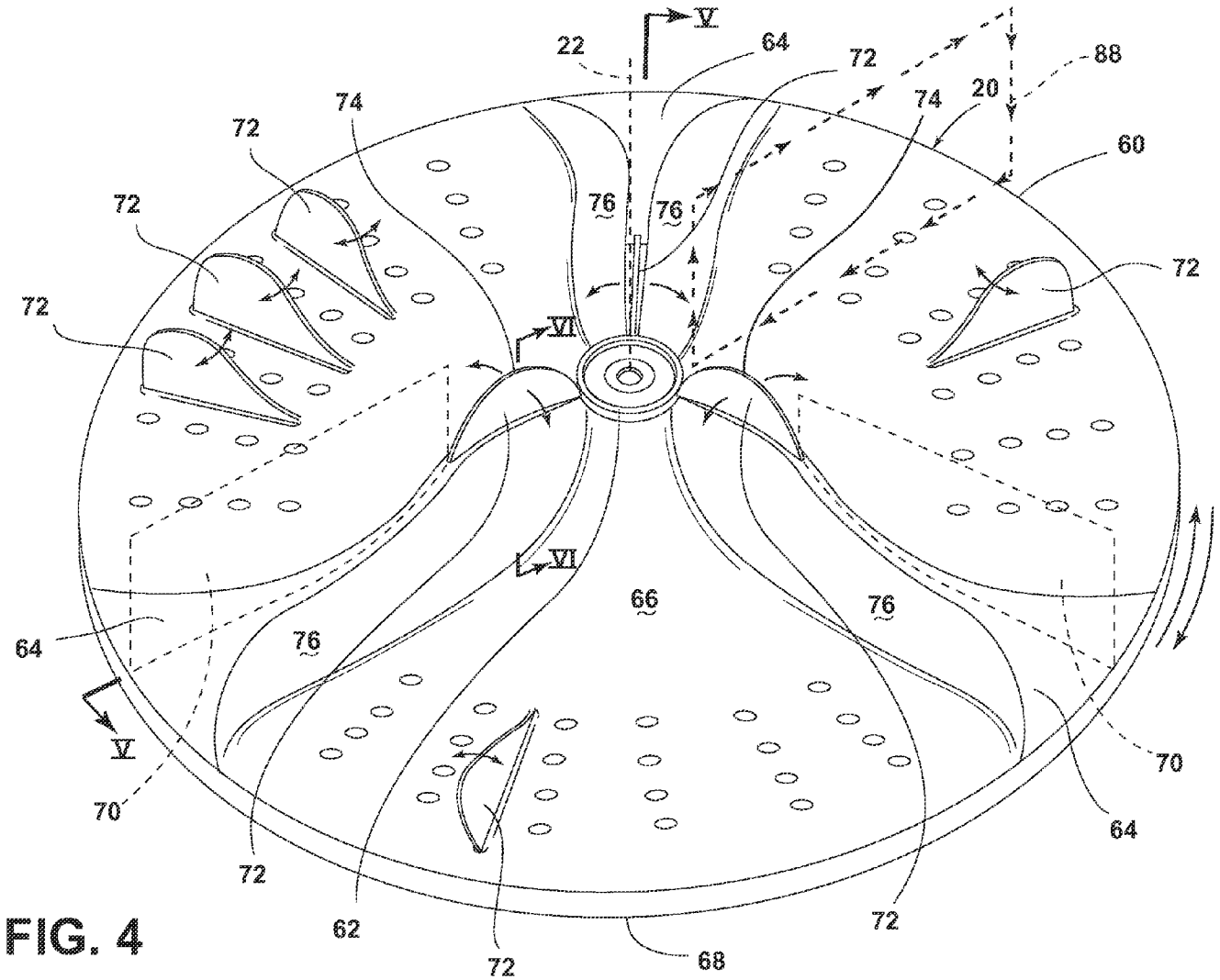
FIG. 4 is an enlarged perspective view of the clothes mover with rigid vanes and flexible vanes illustrated in FIG. 3, and including a schematic representation of inverse toroidal rollover.

FIG. 3 illustrates the perforate basket 18 and the clothes mover 20 in coaxial alignment with the oscillation axis 22. As also illustrated in FIG. 4, the clothes mover 20 may be a circular, somewhat plate-like body characterized by a circumference 60 and a central hub 62. The clothes mover 20 may have an obverse side 66 facing upward for engagement with laundry items, and a reverse side 68 facing the bottom of the basket 18, adapted for mechanical coupling with the drive shaft 24 and coordinated rotation about the vertical oscillation axis 22.

As illustrated in FIG. 4, three radially-disposed vanes 64 may transition upwardly from the obverse side 66. Optionally, a greater or lesser number of vanes 64 may be utilized to achieve a desired effect in contacting and interacting with laundry items and wash liquid in the basket 18, and in agitating the laundry items and the wash liquid.

During a wash cycle and/or a rinse cycle, the clothes mover 20 may be driven by the drive motor 28 for movement within the wash chamber. The basket 18 may be stationary during movement of the clothes mover 20, or the basket 18 may freely rotate during movement of the clothes mover 20. The drive motor 28 may drive the clothes mover 20 to oscillate between a clockwise direction 56 and a counterclockwise direction 58. Oscillation in one of the rotational directions may be referred to herein as a forward stroke, and oscillation in the other of the rotational directions may be referred to herein as a backward stroke. The clothes mover 20 may first move in a clockwise direction 56 through a preselected angular displacement, for example, ranging from 180° to 720°. The clothes mover 20 may then move in a counterclockwise direction 58 through a similar preselected angular displacement. This alternating oscillation may be repeated numerous times during a cycle of operation. A complete forward stroke and backward stroke may be referred to herein as one oscillation cycle.

In a typical wash/rinse cycle, laundry items to form a laundry load may be placed in the basket 18 on top of the clothes mover 20. Some of the laundry items may be in direct contact with the clothes mover 20, and some may not. As the clothes mover 20 oscillates, individual laundry items may be moved directly or indirectly about the interior of the wash chamber by the clothes mover 20, including the vanes 64, thereby imparting mechanical energy to the items.

FIG. 4 also illustrates a plurality of upwardly extending flexible vanes 72. While the flexible vanes 72 are illustrated as evenly and radially distributed about the obverse side 66 of the clothes mover 20, they may be located at other locations and configurations, as long as the desired clothes movement is obtained. As illustrated in FIGS. 3 and 4, the flexible vanes 72 may have a somewhat elongate, fluke-like shape defining a longitudinal body axis, and terminating at their highest points in a tip 74. The flexible vanes 72 may be fabricated of a material having a combination of strength and flexibility suitable for the purposes described herein. The flexibility of the vanes 72 may be uniform throughout. In an alternate embodiment, the flexibility of each vane 72 may be defined by a generally horizontal center section of the flexible vane having a greater flexibility than top and bottom horizontal sections of the flexible vane. In other words, a horizontal center section of each flexible vane 72 may act as a "living hinge," enabling the flexure developed by the flexible vane 72.

Figure 7:
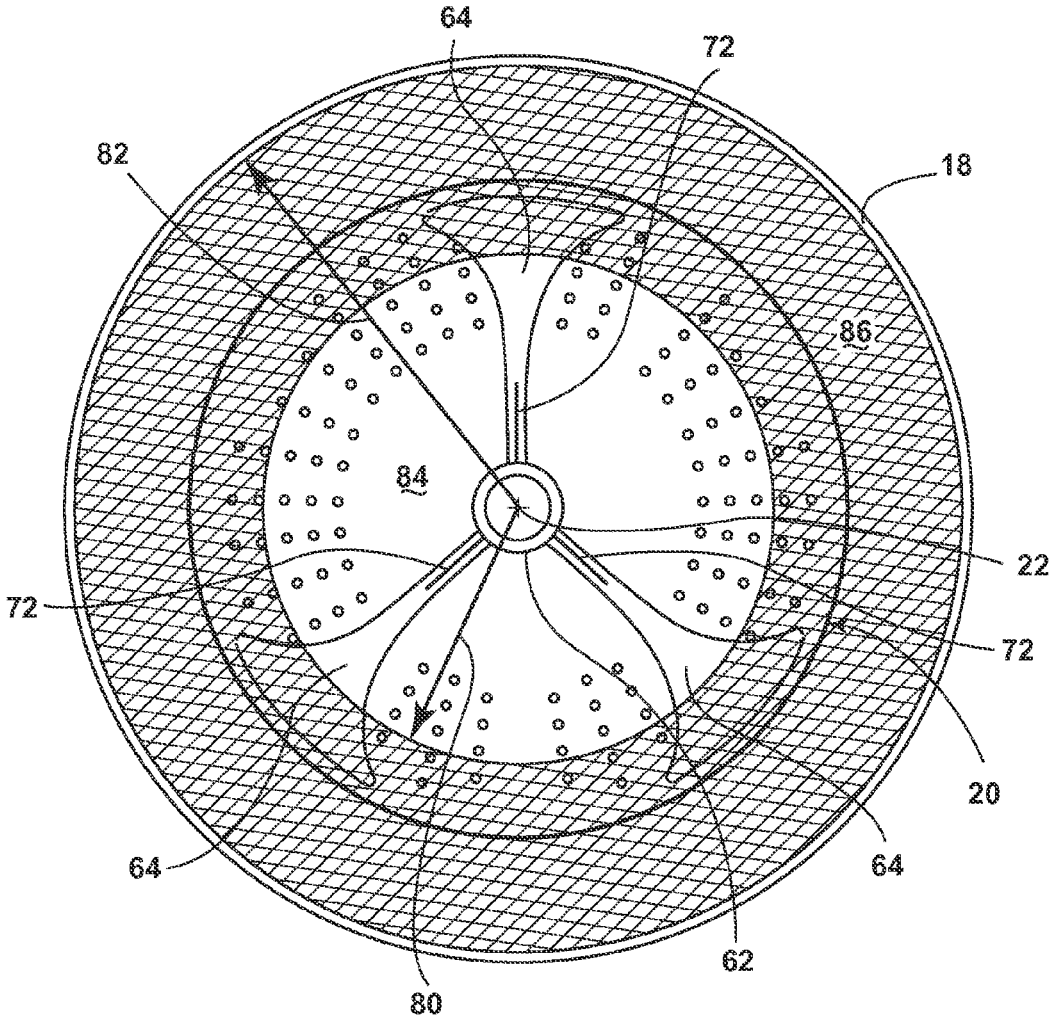
FIG. 7 is an enlarged plan view of the clothes mover and part of the perforate basket illustrated in FIGS. 3 and 4 with a circular center area representing an area of influence of the flexible fins, and an annular area encircling and approximately equal to the center area.

Each flexible vane 72 may extend from the hub 62 to a radial point on a non-flexible vane 64 that may be approximately 70% of the basket radius 82 (FIG. 7). Alternatively, the flexible vanes 72 may have other shapes based upon the configuration of the clothes mover 20, the number and configuration of the vanes 64, a desired motion of the laundry items, and the like. As illustrated in FIG. 4, each flexible vane 72 may be attached to and may extend generally upwardly from a non-flexible vane 64 characterized by a radially-disposed longitudinal plane of symmetry 70, along which the flexible vane 72 may be attached to the non-flexible vane 64.

The number of flexible vanes 72 may be equal to the number of vanes 64, one flexible vane 72 being attached to one non-flexible vane 64. However, the vanes 64 may be omitted, and the flexible vanes 72 may extend directly from the obverse side 66.

FIG. 4 also illustrates a plurality of circumferential flexible vanes 72 extending upwardly from the obverse side 66. The circumferential flexible vanes 72 are illustrated as radially-disposed and regularly-spaced with respect to one another and with respect to the vanes 64. The circumferential flexible vanes 72 may be attached to the obverse side 66 adjacent the circumference 60 of the clothes mover 20. The number of circumferential flexible vanes 72 may vary from 3, i.e. one flexible vane 72 between each pair of adjacent vanes 64, to 9 or more, i.e. three or more flexible vanes 72 between each pair of adjacent vanes 64. The positioning of the flexible vanes 72 along the circumference 60 may be selected based upon the configuration of the clothes mover 20, the number and configuration of the vanes 64, a desired motion of the laundry items, and the like.

The configurations of the circumferential flexible vanes and the vane-mounted flexible vanes 72 may differ as a result of differing performance due to location, height, size, rotational speed, material properties, and the like.

Figure 5:
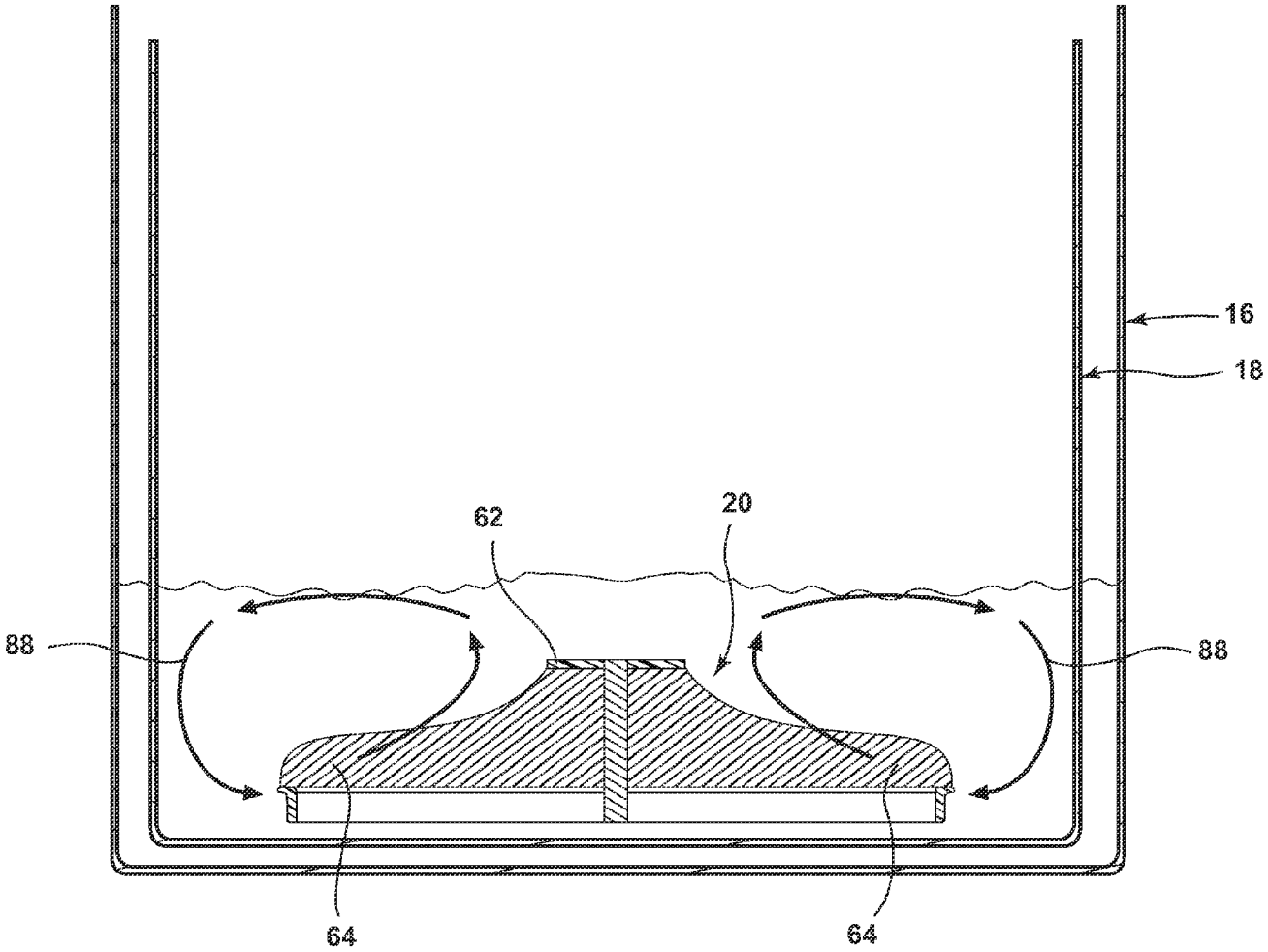
FIG. 5 is a section view taken along view line 5-5 of FIG. 4 illustrating inverse toroidal rollover with the clothes mover, with the flexible vanes omitted for clarity.

FIG. 5 illustrates a path of movement 88 relative to an exemplary clothes mover 20 that may be taken by items of laundry (not shown) during oscillation of the clothes mover 20. This movement 88 may occur without the presence or influence of the flexible vanes 72, and the clothes mover 20 is illustrated without flexible vanes for purposes of clarity. This movement 88 may be referred to as "inverse toroidal movement," and may develop during low-water wash/rinse cycles as illustrated in FIG. 5. Referring also to FIG. 4, inverse toroidal movement 88 may be characterized generally by movement of laundry items radially inwardly along the obverse side 66 of the clothes mover 20 from the perimeter of the basket 18 toward the vertical oscillation axis 22. As laundry items approach the oscillation axis 22, the items may move upwardly, generally parallel to the oscillation axis 22, then radially outwardly toward the basket perimeter, and downwardly along the basket perimeter to repeat the process. Inverse toroidal movement is discussed more fully in U.S. Pat. No. 6,212,722, owned by the assignees of the invention, which is fully incorporated by reference.

Figure 6A:
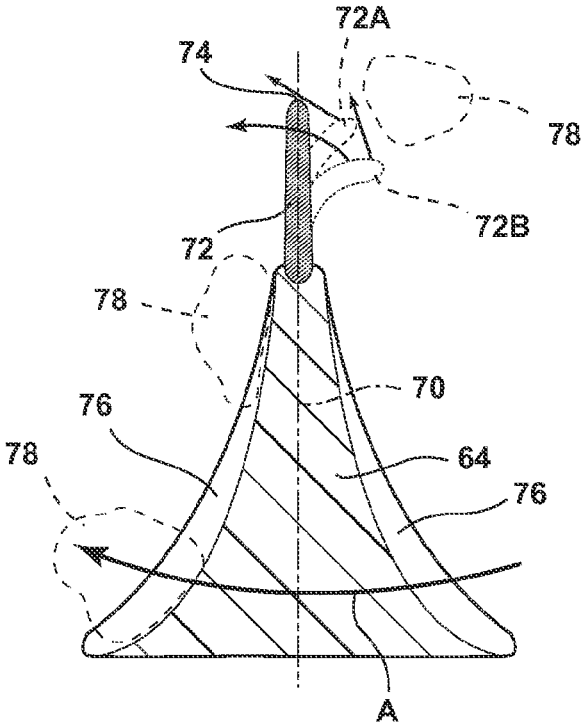
FIGS. 6A & 6B are partial section views of a non-flexible vane and attached flexible vane taken along view line 6-6 of FIG. 4 illustrating upward deflection of laundry items during oscillation of the clothes mover in a clockwise direction and a counterclockwise direction, respectively.
Figure 6B:
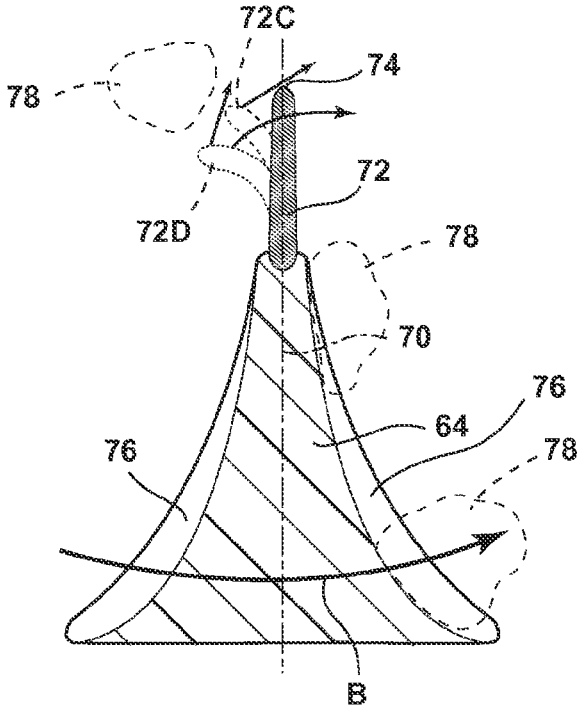

As illustrated in FIGS. 6A & 6B, laundry items 78 in a lower portion of a laundry load may be in contact with the clothes mover 20. The non-flexible vanes 64 may terminate in an upper vane edge along which the flexible vanes 72 may be attached. All or part of opposed vane surfaces 76 may contact the laundry items 78 during clockwise rotation 56 and counterclockwise rotation 58 of the clothes mover 20. The non-flexible vanes 64 being rigid, laundry items 78 may tend to move upwardly along a vane surface 76, particularly as the items approach the vertical oscillation axis 22. For example, in FIG. 6A, the non-flexible vane 64 is illustrated rotating about the vertical oscillation axis 22 in a clockwise direction 56. If wash liquid and/or laundry items extend above the non-flexible vanes 64 to intersect the flexible vanes 72, the flexible vanes 72, in contact with the wash liquid and/or laundry items, may deflect in a direction opposite the direction of rotation.

The flexible vanes 72 may tend to return to an upright vertical configuration, thereby imparting a generally upward force on the laundry items 78 in contact with the flexible vanes 72. This upward force may effectively increase when the clothes mover 20 slows as it approaches the end of its stroke.

As the clothes mover 20 begins to rotate in a counterclockwise direction 58, as illustrated in FIG. 6B, the flexible vanes 72 may tend to deflect in a direction opposite the direction of rotation. Laundry items 78 may be in contact with or suspended somewhat above the flexible vanes 72 as a result of the upward movement of the laundry items 78 due to inverse toroidal rollover or the influence of the previous stroke. The upward force exerted by the flexible vanes 72 on the suspended laundry items 78 may continue to move the laundry items 78, but now in a somewhat opposite direction from that taken during the previous stroke. Thus, as the flexible vanes 72 move from a rightward deflection, as illustrated in FIG. 6A, to a leftward deflection, as illustrated in FIG. 6B, laundry items 78 may be propelled over the non-flexible vane 64 from right to left, then downward, as the clothes mover 20 and non-flexible vane 64 continue rotating in a counterclockwise direction 58 away from the laundry items 78. The net result may be enhancement of the upward travel of the laundry items 78 along the vertical oscillation axis 22.

The circumferential flexible vanes 72 may respond to rotation of the clothes mover 20 in a similar manner, i.e. facilitating inverse toroidal flow by moving laundry items 78 laterally along the obverse side 66 of the clothes mover 20 toward the non-flexible vanes 64, where the laundry items 78 can engage the non-flexible vanes 64 and flexible vanes 72, as previously described.

FIG. 7 illustrates a radius of influence 80, also referred to as a "halfway point," within which the flexible vanes 72 may be positioned. A center area 84 defined by the radius of influence 80 may equal 50% of a total area circumscribed by the perimeter of the basket floor, and may define an area in which the vane-mounted flexible vanes 72 should be placed for optimal effectiveness. An annular area 86 defined by the radius of influence 80 and the basket radius 82 may therefore equal 50% of the total area. This 50/50 division of areas may differ somewhat depending upon factors such as the dimensions of the basket 18, the size of the clothes mover 20, the configuration of the non-flexible vanes 64, the configuration and properties of the flexible vanes 72, and the like.

Figure 8:
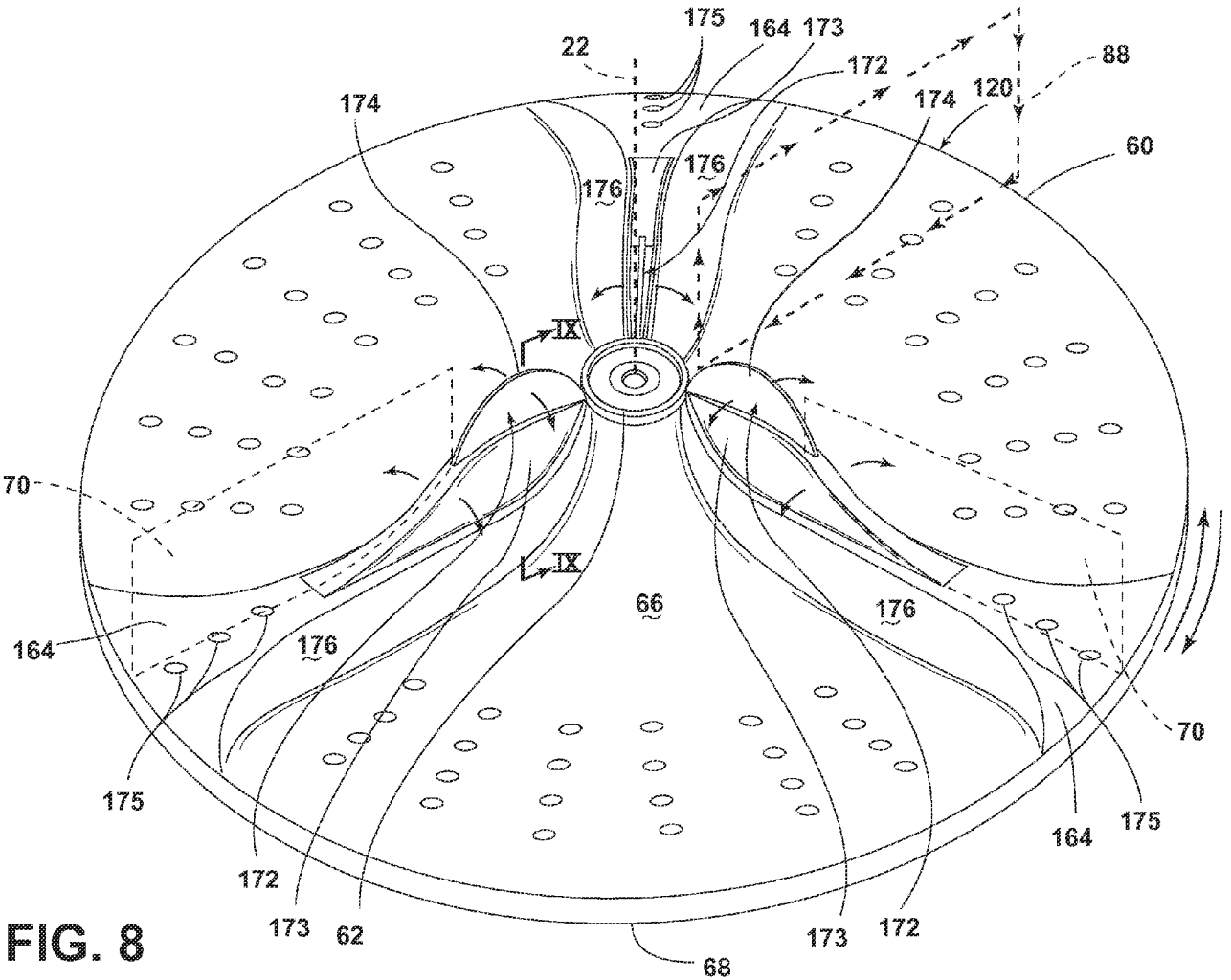
FIG. 8 is an enlarged perspective view of a clothes mover with rigid vanes and flexible vanes according to a second embodiment of the disclosure.

FIG. 8 illustrates an alternative clothes mover 120 configuration according to a second embodiment of the disclosure. The second embodiment is similar to the first embodiment; therefore, like parts will be identified with like numerals increased by 100, with it being understood that the description of the like parts of the first embodiment applies to the second embodiment, unless otherwise noted. A difference between the first embodiment and the second embodiment is that the relative height of the flexible vanes 172 extending normally from the clothes moves 120 includes a first include a first flexible base 173 or body portion defining a first flex axis, extending away from the obverse side 66, and a second flexible tip 174, defining a second flex axis, and extending from the first flexible base 173, when compared to the first embodiment. In one example embodiment, the height of the non-flexible vanes 164 can be 30% of the total vane height, and the flexible vane 172 can be 70% of the total vane height, and wherein 60% of the flexible vane 172 height is the flexible base 173 while 40% of the flexible vane 172 height is the flexible tip 174. Additional configurations and height percentages can be included in embodiments of the disclosure. In this sense, a portion of the flexible vanes 172 can replace a portion of the non-flexible vanes 164. The total vane height extending away from the obverse side 66 can be equal to, or different from, the total vane height of the first embodiment. Additionally, the flexible base 173 and flexible tip 174 can be configured to define different bending or flexing modes, configurations, moments, or the like, as described below. Additional differences are described herein.

FIG. 8 illustrates a plurality of upwardly extending flexible vanes 172. While the flexible vanes 172 are illustrated as evenly and radially distributed about the obverse side 66 of the clothes mover 120, they can be located at other locations and configurations, as long as the desired clothes movement is obtained. The flexible vanes 172 can have a somewhat elongate, hump-like shape defining a longitudinal body axis, and can include a first flexible hump-like base 173 or body portion defining a first flex axis, extending away from the obverse side 66, and a second flexible hump-like tip 174, defining a second flex axis, and extending from the first flexible base 173.

The flexible vanes 172, 173, 174 can be fabricated of a material having a combination of strength and flexibility suitable for the purposes described herein. Additionally, the flexible vanes 172, 173, 174 can be fabricated in similar or dissimilar opaque or translucent accent colors to highlight the vanes 172, 173, 174 against the clothes mover 120. The flexibility of the flexible base 173 and the flexible tip 174 can be uniform throughout, or can vary over the length of the base 173 or tip 174, as they extend away from the obverse side 66. For example, the flexible base 173 can be configured to flex, yet provide increased rigidity, compared with the flexible tip 174. In an alternate embodiment, the flexibility of each flexible base 173 or flexible tip 174 can be defined by a generally horizontal center section of the respective base 173 or tip 174 having a greater flexibility than top and bottom horizontal sections of the respective base 173 or tip 174. In other words, a horizontal center section of each flexible base 173 or flexible tip 174 can act as a "hinge," enabling the flexure developed by the flexible vane 172.

Each flexible vane 172 can extend from or mount with the hub 62 to a radial point on a non-flexible vane 164. Alternatively, the flexible vanes 172 can have other shapes based upon the configuration of the clothes mover 20, the number and configuration of the vanes 164, a desired motion of the laundry items, and the like. As illustrated in FIG. 8, each flexible vane 172 can be attached to and can extend generally upwardly from a non-flexible vane 164 characterized by a radially-disposed longitudinal plane of symmetry 70, along which the flexible base 173 can be attached to the non-flexible vane 164. Also illustrated, the non-flexible vanes 164 can include a plurality of circular openings 175 therethrough for drainage of wash liquid, or spraying or "spurting" of liquid, through the clothes mover 120. Alternatively, the non-flexible vanes 164 can have openings 175 of other than a circular configuration, or can have no openings.

The number of flexible vanes 172 can be equal to the number of non-flexible vanes 164, one flexible vane 172 being attached to one non-flexible vane 164. However, embodiments of the disclosure can include configurations wherein the non-flexible vanes 164 are omitted, and the flexible vanes 172 can extend directly from the clothes mover 120. Additionally, each flexible vane 172 radially spaced about the clothes mover 120 can be independently configured, that is, configured with a vane described in the first embodiment, a vane described in the second embodiment, or a variation of the first or second embodiment. Moreover, while not illustrated, a plurality of circumferential flexible vanes 72 described in the first embodiment can be included in the clothes mover 120 of the second embodiment. The positioning of the flexible vanes 72, 172 along the circumference 60 can be selected based upon the configuration of the clothes mover 120, the number and configuration of the vanes 164, a desired motion of the laundry items, and the like. The configurations of the circumferential flexible vanes 72 or the vane-mounted flexible vanes 172 can differ as a result of differing performance due to location, height, size, rotational speed, material properties, and the like.

Figure 9A:
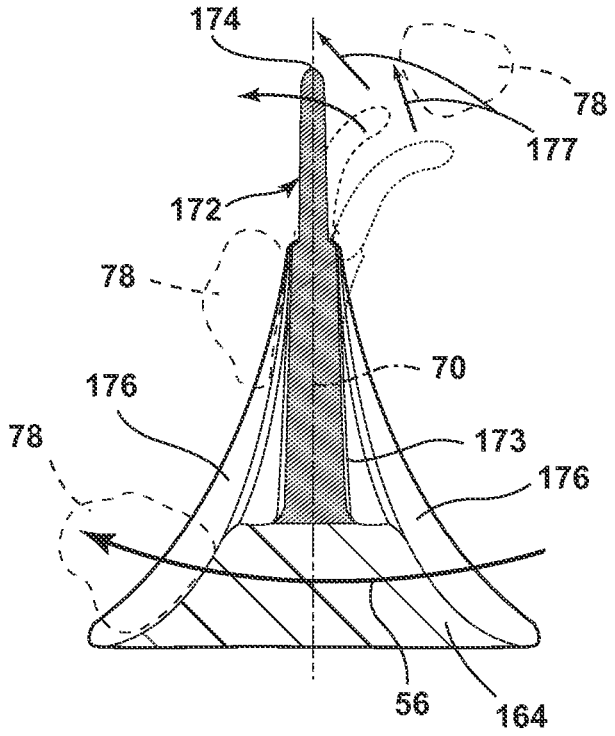
FIGS. 9A & 9B are partial section views of a non-flexible vane and attached flexible vane taken along view line 9-9 of FIG. 8 illustrating upward deflection of laundry items during oscillation of the clothes mover in a clockwise direction and a counterclockwise direction, respectively.
Figure 9B:
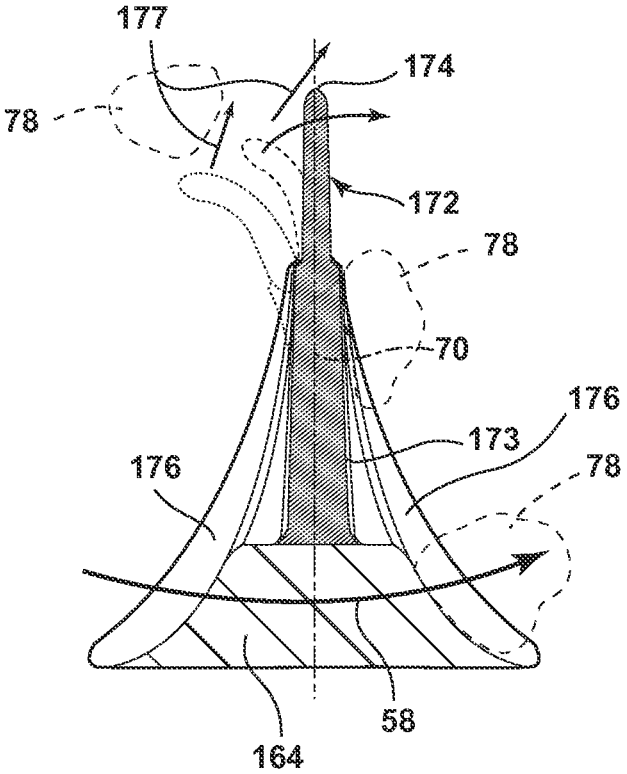

As illustrated in FIGS. 9A & 9B, laundry items 78 in a lower portion of a laundry load can be in contact with the clothes mover 120. The non-flexible vanes 164 can terminate in an upper vane edge along which the flexible vanes 172 or flexible base 173 can be attached. The flexible vanes 172, flexible base 173, or flexible tip 174 (also illustrated in a flexed dotted outline) tend to return to an upright vertical configuration (tendency shown as arrow 177), thereby imparting a generally upward force on the laundry items 78 in contact with the flexible vanes 172, flexible base 173, or flexible tip 174. This upward force can effectively increase when the clothes mover 120 slows as it approaches the end of its stroke. As shown, the portion of the elongated body including the flexible base 173 is greater than, or taller than the portion of the elongated body including the flexible tip 174.

As the clothes mover 120 begins to rotate in a counterclockwise direction 58, as illustrated in FIG. 9B, the flexible vanes 172, flexible base 173, or flexible tip 174 can tend to deflect in a direction opposite the direction of rotation. As shown, the cross section of the flexible base 173 can be larger or wider, in the direction of the flexing, than the cross section of the flexible tip 174. The larger or wider cross section can, for example, result in an increase of the resistance to bending or flexing of the flexible base 173 when compared to the resistance to bending or flexing of the flexible tip 174 (e.g. the tip 174 bends more than the base 173). As used herein, the resistance to bending or flexing of an element can be described as the flexural modulus or the bending modulus, which is the ratio of stress to strain in flexural deformation, or the tendency of a material to bend. The resistance to bending can also be described as the moment of bending, which is the reaction induced in a structural element when an external force or moment is applied to the element. The different resistances to bending, moments of bending, flexural moduli, or bending moduli of the flexible base 173 and flexible tip 174 are illustrated in FIGS. 9A and 9B, wherein the deflection of the flexible tip 174 can be greater than the deflection of the flexible base 173, when each of the base 173 and tip 174 are exposed to interaction with the laundry items 78.

All or part of the opposed vane surfaces 176 can contact the laundry items 78 during clockwise rotation 56 and counterclockwise rotation 58 of the clothes mover 120. The non-flexible vanes 164 being rigid, laundry items 78 can tend to move upwardly along a vane surface 176 to the flexible vane 172 portion, wherein interaction of the laundry items 78 with the flexible vane 172 cause the bending or flexing of the flexible base 173 and flexible tip 174. The flexing of the flexible base 173 and flexible 174, in turn, result in the tendency to move further upward along the vane surface 176 due to the tendency 177 of the flexible base 173 and flexible tip 174 to return to an upright vertical configuration.

Laundry items 78 can be in contact with or suspended somewhat above the non-flexible vanes 164, the flexible vanes 172, the flexible base 173, or the flexible tip 174 as a result of the upward movement of the laundry items 78 due to inverse toroidal rollover or the influence of the previous stroke. The upward force exerted by the flexible vanes 172, flexible base 173, or flexible tip 174 on the suspended laundry items 78 can continue to move the laundry items 78, but now in a somewhat opposite direction from that taken during the previous stroke. Thus, as the flexible vanes 172, flexible base 173, or flexible tip 174 move from a rightward deflection, as illustrated in FIG. 9A, to a leftward deflection, as illustrated in FIG. 9B, laundry items 78 can be propelled over the non-flexible vane 164 from right to left, then downward, as the clothes mover 20 and non-flexible vane 164 continue rotating in a counterclockwise direction 58 away from the laundry items 78. The net result can be enhancement of the upward travel of the laundry items 78 along the vertical oscillation axis 22 without causing damage to the laundry items 78 by yielding to damage-causing interactions between the flexible vanes 172 and the items 78. In addition to preventing damage to the laundry items 78, the above-described embodiments can also reduce the wear on laundry items, prolonging the longevity of the items 78.

As described herein, embodiments of the disclosure can include a "triple action" clothes mover 20, 120 for a washing machine 10 that include at least three actions comprising reciprocation of the clothes mover 20, 120, blowing (i.e. "spurting") or draining of water or wash liquid through circular openings in the clothes mover 20, 120, and flexing of the tip 74, 174 of the flexible vane 72, 172. Alternatively, embodiments of the disclosure can include a "quad action" clothes mover 20, 120 for a washing machine 10 that includes at least four actions comprising at least the three actions described in the triple action clothes mover 20, 120, and further comprising flexing of the flexible base 173 of the flexible vane 72, 172.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A washing machine for treating laundry according to at least one automatic cycle of operation, comprising:

a basket having a bottom wall and a peripheral side wall extending upwardly from the bottom wall to at least partially define a treating chamber with an open top, with the basket rotatable about a first rotational axis;

a clothes mover located within the treating chamber, proximate the bottom wall, and having a base with a centrally located hub concentric with a second rotational axis about which the clothes mover reciprocally rotates;

a plurality of non-flexible vanes having an upper surface and extending upwardly from the base and extending away from the hub; and a plurality of flexible vanes having an elongated body extending away from the hub and projecting upwardly from the upper surface, wherein each of the plurality of flexible vanes includes a flexible body portion having a first end proximate the hub and a second end, opposite the first end, and a flexible tip extending away from the flexible body portion;

wherein the flexible vanes flex about a first flex axis defined by the flexible body portion and a second flex axis defined by the flexible tip, and wherein the first flex axis and second flex axis are not parallel to either of the first and second rotational axes.

2. The washing machine of claim 1 wherein at least one of the first flex axis or the second flex axis is generally parallel to a body axis of the elongated body.

3. The washing machine of claim 1 wherein the hub comprises a plurality of non-flexible vanes, corresponding with the plurality of flexible vanes, wherein the first end of the flexible body portion mounts with the non-flexible vane.

4. The washing machine of claim 3 wherein the plurality of non-flexible vanes are rigid.

5. The washing machine of claim 1 wherein the elongated body has a length less than 50% of the length of a radial line extending from the second rotational axis to the peripheral wall.

6. The washing machine of claim 1 wherein a first portion of the elongated body including the flexible body portion is taller than a second portion of the elongated body including the flexible tip.

7. The washing machine of claim 1 wherein the elongated body comprises a second end, opposite the first end, and the elongated body is located on the clothes mover such that the second end does not reside beyond a halfway point between the second rotational axis and the peripheral wall.

8. The washing machine of claim 7 wherein the first end abuts the hub.

9. The washing machine of claim 1 wherein a deflection of the flexible tip is greater than a deflection of the flexible body portion.

10. The washing machine of claim 1 wherein the resistance to bending of the flexible body portion is greater than the resistance to bending of the flexible tip.

11. The washing machine of claim 1 wherein the clothes mover comprises a base having a plurality of openings.

12. The washing machine of claim 11 wherein the clothes mover further comprises at least one non-flexible vane.

13. The washing machine of claim 1 wherein at least some of the flexible vanes flex in a direction to impart an upward force on laundry in contact with the vanes.

14. The washing machine of claim 1 wherein the first and second rotational axes are coaxial.

15. The washing machine of claim 13 wherein the flexible vanes are configured to flex in a direction opposite the direction of rotation of the clothes mover to impart the upward force.

16. A washing machine for treating laundry according to at least one automatic cycle of operation, comprising:

a basket having a bottom wall and a peripheral side wall extending upwardly from the bottom wall to at least partially define a treating chamber with an open top, with the basket rotatable about a first rotational axis;

a clothes mover located within the treating chamber, proximate the bottom wall, and having a base with a centrally located hub concentric with a second rotational axis about which the clothes mover reciprocally rotates;

a plurality of non-flexible vanes having an upper surface and extending upwardly from the base and extending away from the hub toward the peripheral side wall a first distance; and a plurality of flexible vanes having an elongated body extending away from the hub a distance less than the first distance and projecting upwardly from the upper surface, wherein each of the plurality of flexible vanes includes a flexible body portion having a first end proximate the hub and a second end, opposite the first end, and a flexible tip extending away from the flexible body portion;

wherein the flexible vanes flex about a first flex axis defined by the flexible body portion and a second flex axis defined by the flexible tip, and wherein the first flex axis and second flex axis are not parallel to either of the first and second rotational axes.

* * * * *